US005290611A

United States Patent [19]

Taylor

[11] Patent Number: 5,290,611

[45] Date of Patent: Mar. 1, 1994

[54] INSULATIVE SPACER/SEAL SYSTEM

[76] Inventor: Donald M. Taylor, R.R. #1, Orangeville, Ontario, Canada, L9W 2Y8

[21] Appl. No.: 609,336

[22] Filed: Nov. 5, 1990

Related U.S. Application Data

[63] Continuation-in-part of Ser. No. 366,069, Jun. 14, 1989, abandoned.

[51] Int. Cl.[5] ..... E06B 3/24

[52] U.S. Cl. ..... 428/34; 428/137; 428/172; 428/167; 428/192; 52/790

[58] Field of Search ..... 428/34, 131, 137, 156, 428/167, 172, 192; 156/107, 109; 52/788-790

[56] References Cited

U.S. PATENT DOCUMENTS 5,079,054 1/1992 Davies ..... 428/35.8

FOREIGN PATENT DOCUMENTS 2409855 7/1979 France ..... 428/167

*Primary Examiner*—Donald J. Loney

*Attorney, Agent, or Firm*—Caesar, Rivise, Bernstein, Cohen & Pokotilow, Ltd.

[57] ABSTRACT

An insulative, gas impermeable spacer frame is provided for the precision separation of two or more transparent glass or plastic panes, and is hermetically sealed in place to prevent the ingress or egress of moisture vapor, and to contain various noble gases, or air, between the adjacent panes, being used in insulated lights for windows and doors. The spacer is made of insulative organic material of suitable stiffness such as cardboard, or plastic over which is applied a coating or lamination of gas and moisture vapor barrier materials, thus forming a composite insulative web which may be fabricated into tubular structures to form separate frame units. Such spacer structures may possess extremely low thermal conductivity, so as not to constitute a thermal bridge between the panes being separated, thereby diminishing and even eliminating the problem of window edge frosting and/or peripheral dew point development, such as occurs when metal spacer devices are used. The hollow, tube-like spacer form may be used to contain desiccant materials for absorbing moisture and an organic vapors that evolve or may be present within the hollow window cavity, created when the spacer is sealed in place. The material or materials for the improved insulating spacer may be supplied in a flexible, planar, ribbon-like form, of continuous length rather or as a preformed stiff section, as at present, thus enabling the economic advantages of making various sizes of spacer frames without the cut-off losses which otherwise occurs when such spacer assemblies are cut from stock lengths of rigid, preformed hollow profile. However, the provision of the unique spacer, made up into predetermined lengths also is contemplated. The rigid stock lengths are then readily square cut or mitered and jointed with insert joints, to form insulating spacer frames. The provision of a protective film, against ultra violet degradation may also be readily incorporated in the spacer or coating formulation.

20 Claims, 6 Drawing Sheets

FIG. 8 A.
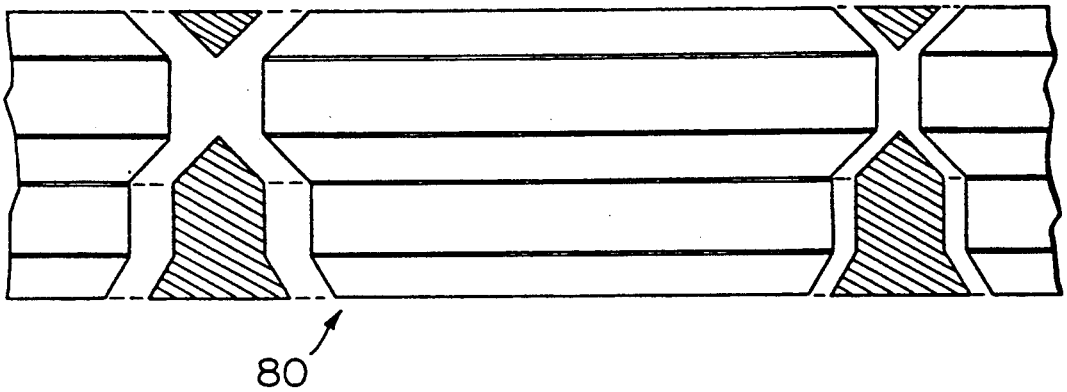
FIG. 8B.
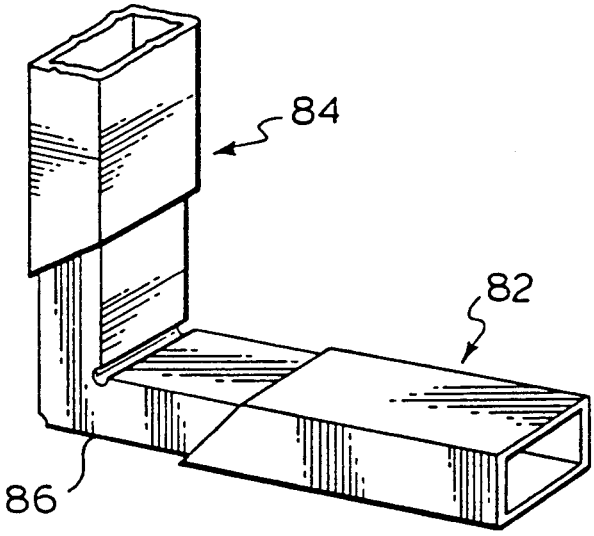
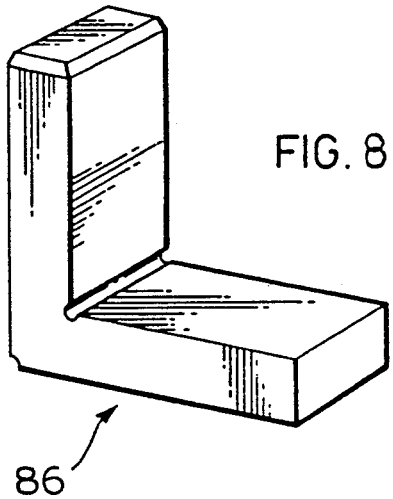
FIG. 8 C.

INSULATIVE SPACER/SEAL SYSTEM

This is a continuation-in-part of application No. 07/366,069 filed Jun. 14, 1989 now abandoned.

TECHNICAL FIELD

The invention is directed to insulated spacer systems for use in fabricating multi-paned lights.

BACKGROUND ART

The manufacture of multi-paned window lights for use in the glazing of windows and doors requires that a controlled insulative distance be kept between the adjacent glazing panel panes. Ideally, this gap distance should be defined by a peripheral frame, which is hermetically sealed to the spaced apart panes thus creating a confined "dead air" space, which may be optionally filled with an improved insulative gas.

Such spacer frames have usually been roll-formed, using tubular type aluminum profile sectioned frame materials, the hollow interior of which frequently serves to receive moisture vapor desiccants, for the removal of any moisture that may be present within the sealed construction. While such metal spacers form an effective moisture vapor barrier, they also possess high thermal conductivity characteristics, with a conductivity coefficient "k" value in excess of 117 which creates a thermal bridge between the panes being separated. This construction is responsive to dew point levels and can lead to the accumulation of moisture, as condensation and frost around the glazing panel periphery. Such accumulations are undesirable aesthetically as well as being potentially destructive to adjoining structures, due to staining and moisture damage.

Thermally insulative spacers have been made from thermosetting and thermoplastic materials by the pull-trusion or extrusion process, which indeed have overcome the thermal insulative problem, but have failed to durably respond to the requirements of low gas permeability, resistance to sunlight degradation due to the action of ultra-violet light energy and have caused internal "fogging" of the glazing panel due to outgassing of hydrocarbon vapours from the plastics used, which can condense on the internal faces of the inner and/or outer panes. The developing use of special glazing glasses has tended to exacerbate ultra-violet degradation, tending to reflect and build up the ultra-violet level.

It will be further understood that, in addition to thermal insulation and gas encapsulation and retention performance, which are particularly important, the requirement also exists for practical, low cost, effective spacers that require a minimum of waste during fabrication, lend themselves to ready formation and installation, and which provide for the incorporation of absorbents for moisture vapor and other, hydrocarbon gases, to extend the service lifespan of a sealed, insulative glazing panel.

Various aspects of the prior art are to be found in the following United States patents which are directed to multipaned window systems and components thereof.

| | | |
|---|---|---|
| 49,167 | August 1865 | Stetson |
| 3,314,204 | April 1967 | Zopnek |
| 3,280,523 | October 1966 | Stroud et al. |
| 4,015,394 | April 1977 | Kessler |
| 4,109,431 | August 1978 | Mazzoni et al. |

-continued

| | | |
|---|---|---|
| 4,658,553 | April 1987 | Shingawa |
| 4,719,728 | January 1988 | Erikson et al. |
| 4,649,685 | March 1987 | Wolf et al. |
| 4,567,841 | March 1986 | Lingemann |
| 4,564,540 | January 1986 | Davies et al. |
| 4.226,063 | October 1980 | Chenel |
| 4,222,213 | September 1980 | Kessler |
| 4,113,905 | September 1978 | Kessler |
| 4,198,254 | April 1980 | Laroche et al. |
| 3,965,638 | June 1976 | Newman |
| 3,935,683 | February 1976 | Derner et al. |

In various solutions, ranging from Stetson to Derner et al., various aspects of spacer provisions, and of their respective limitations may be fairly readily identified. In addition to complexity, the costing aspects of each spacer system must be born in mind as well as the need to extend the sealing life expectancy of the spacer. Only an established, long term life of several years duration can effectively validate the longevity of seal effectiveness that may be achieved by a particular system.

A further, highly significant aspect of any such spacer system is its suitability for assembling into a window unit. Factors such as ease of handling; handling robustness; longitudinal and lateral stiffness; ease of cutting to length and facility for forming joints, particularly corner joints; suitability for applying adhesives to selected surfaces, are all relevant factors in determining the suitability of spacer elements.

In the case of pultruded, glass reinforced plastic sections, these are generally of considerable thickness, which complicates corner formation. These sections generally possess an unacceptably high gas permeability, while also tending to emit hydrocarbon vapours into the sealed space between the glazing panes. They are also a comparatively high cost item.

Extruded and roll formed metal sections, which are widely used, create a highly conductive thermal bridge, leading to dew line formation.

In reviewing the various aspects of the prior art it should be born in mind that an ideal spacer should be of low cost; should possess extremely high resistance to gas percolation therethrough; be suitably constituted to traverse the corners of the panes; possess high resistance to degradation; be laterally flexible, readily applied, and effectively adhered and edge- sealed; structurally stable; of sufficient mechanical strength for installation; and possessing a low edge-to-edge thermal conductivity factor.

Costs have been known to run as high as ninety cents Canadian per lineal foot, for a compound aluminium/-plastic section, constituting a thermally broken aluminum seal.

DISCLOSURE OF INVENTION

The present invention provides a multi-layer glazing panel separation system incorporating, or to which may be applied, a seal means to provide a hermetic seal between opposed, substantially parallel gas impermeable glazing panels, comprising: an elongated ribbon-like section of low cost insulative organic substrate material such as cardboard having a plurality of lateral panel portions of predetermined transverse width and lateral edge to edge load bearing capacity and low thermal conductivity; a barrier layer of substantially gas impermeable and ultraviolet degradation resistant material on at least one transverse portion of the section to substantially preclude on a long-term basis the percolation of benign gases and air therethrough; and edge means for securing the seal in edge sealed relation to adjoining portions of respective window panes.

In one embodiment of the invention there is provided a composite insulative spacer for the precision separation of glazing panels in substantially mutually parallel relation, comprising an organic resilient substrate having a coefficient of thermal expansion compatible in use with the glazing panels, the substrate being faced with an overcladding layer of gas impermeable barrier such as polyvinyl alcohol or polyvinylidene chloride, and material preferably selected from the group comprising polyvinyl alcohol, polyvinylidene chloride, thermoplastic polyesters and ethylene vinyl alcohol copolymers, a metallic layer and combinations thereof applied to selected surfaces of the substrate.

The subject spacer may be economically provided as a ribbon of predetermined width, foldable laterally into a plurality of longitudinally extending narrow panels, to form a fabricated spacer section; the spacer section when formed having at least one of the panels substantially lying in a plane normal to the plane of the fabricated spacer frame, at least one face of the panel being covered edge to edge by seal diaphragm means in gas and vapour substantially non-permeable, sealing relation, the ribbon panels being of predetermined stiffness, laterally, whereby in use the spacer section possesses predetermined values of lateral stiffness and low edge-to-edge thermal conductivity. In a number of embodiments of the invention a plurality of longitudinal fold lines may be provided, to facilitate lateral folding of the ribbon to form the spacer section, the fold lines extending substantially parallel, longitudinally of the ribbon. The fold lines generally comprise indentations wherein the thickness of the ribbon section is locally diminished.

A range of low cost organic substrate materials possessing the requisite strength and formability characteristics may be used, including cardboard and Keyes (T.M.) fiber board as well as extruded or calendered foam thermoplastic sheeting.

Cardboard is readily available in mill roll form, up to 1000 feet continuous length. Thirty point and sixty point cardboard, respectively 0.5 millimeters (mm) and 1.5 mm thick, appear suitable. A reflective and sealing diaphragm may include aluminum foil of 0.001 inches or less, possibly laminated with or vapour deposited on Saran (T.M.) thermoplastic. Other sealant foil materials may comprise tin foil, lead foil, and even gold foil.

A reflective diaphragm may be applied to the portion of the substrate forming the spacer surface enclosing the inner periphery of the glazing panel, generally being slightly undersized to avoid formation of a thermal bridge between the two glazing panels. It will be understood that the sealing diaphragm is generally not a requirement for the full lateral extent of the ribbon.

An insulative spacer, fabricated from an organic material may have a thin metallic foil or coating applied to the inner surface of an enclosure into which the spacer is formed. Extremely thin guage coatings, in the order of 0.0125 through 0.0375 m.m. can form a gas impermeable membrane, isolated from contacting the glass pane.

The provision of a spacer material in ribbon form permits coiling of the ribbon, in an unfolded planar configuration, into rolls of extended length, elsewhere referred to as being "endless", from which portions may be readily and precisely cut to desired length to form an insulative spacer, frame-shaped seal of desired, predetermined peripheral length for a selected size of installation. The planar nature of the coiled ribbon-like spacer permits cutting of suitable notches into side panel portions of the ribbon, generally as defined by the appropriate fold lines, and the precise application of lateral bend creases, enabling the precise location of the respective corners of the peripheral frame seal.

Formation of the thus prepared ribbon into a closed or semi-closed box section then provides a peripheral seal comprising a container section within which an appropriate quantity of dessicant material may be inserted. The form of the ribbon formulation, facilitates formation of the ribbon into a precisely structured, strong section, readily capable of withstanding the lateral loads to which the window panes are subject, during assembly. The final sealing and load bearing capability of the spacer is usually supplemented by the provision of a peripheral secondary seal of polysulphide plastic which serves also to protectively isolate the subject spacer and sealant seal construction.

The material thickness and/or width of a metallic seal diaphragm may be applied such as not to constitute a thermal bridge.

Ultraviolet protection may be provided by applying a surface coating pigmented with a combination of carbon black and other metallic oxides such as iron.

Superior sealing against gas leakage may be achieved, using a polyvinyl alcohol layer, applied as a coating or film, and protected against moisture degredation by a layers of Saran (T.M.) polyvinylidene Chloride. The Saran also can serve as a sealing and protective covering and also as a bonding agent between section faces to be adhered to each other.

The generally closed nature of the formed section also has a self-protective function for the inner surfaces thereof, against ultra-violet degradation, in addition to the provision of other function-specific protective coatings. The box section formation facilitates the provision of corner reinforcement, comprising insertable plastic corner pieces, or L-shaped section-side reinforcements, in the frame-like seal.

The present invention further provides a method of fabricating a multi-layer window light having a plurality of panes in peripheral, hermetically sealed relation, comprising the steps of: providing an endless ribbon of predetermined width and lateral stiffness, and having at least one selected area thereof substantially gaseously non-permeable and possessing a predetermined limiting value of edge-to-edge thermal conductivity thereacross severing a predetermined length of the ribbon; folding the ribbon laterally along longitudinally extending fold lines to form an elongated spacer section; jointing the ribbon length intermediate the ends thereof to form a frame-like enclosure; joining and sealing the ends of the ribbon length, to complete the enclosure; installing the enclosure in planar oriented relation as a spacer between a pair of window panes, to enclose a space between the panes, within the enclosure; and sealing the enclosure in hermetic, sealing relation with the panes, to preclude the undesired transfer of gas and vapour relative to the space. The method may further include the insertion of desiccant material within selected portions of the respective hollow sections forming the sides of the seal enclosure, including perforating the ribbon in predetermined areas, to provide breathing access between the desiccant material and the hermetically sealed space between the window panes, for the absorption of any moisture or hydrocarbon vapours that are present or may evolve.

Such breathing access perforations may be drilled into an appropriate surface of the formed section, or punched out of an appropriate ribbon panel, or provided by the cutting of appropriate panel corner reliefs.

It will be understood that the presently disclosed seal may be made up into formed sections of pre-cut length, such as 7 meters. The preformed length can then be readily made up into spacer frames of a desired shape. Such spacer frames may utilize various types of corner joint in inserted relation within the section, to provide an effective window seal.

Further seal embodiments include pairs of U-sections assembled in mutual adhering relation to form closed box sections. The use of a Saran coating at the section interfaces makes possible the heat sealing of adjoining faces, without requiring adhesive.

BRIEF DESCRIPTION OF THE DRAWINGS

Certain embodiments of the invention are described, by way of example, without limitation of the invention thereto, reference being made to the accompanying drawings, wherein:

FIG. 8A is a plan view of a multi-panel ribbon showing corner joint embodiment relief cut-outs;

FIG. 8B is an isometric view of a section embodiment incorporating an insertable corner angle, in partially assembled relation;

FIG. 8C is an isometric view of the insertable corner piece of the FIG. 8B embodiment;

BEST MODE OF CARRYING OUT THE INVENTION

Figure 1:
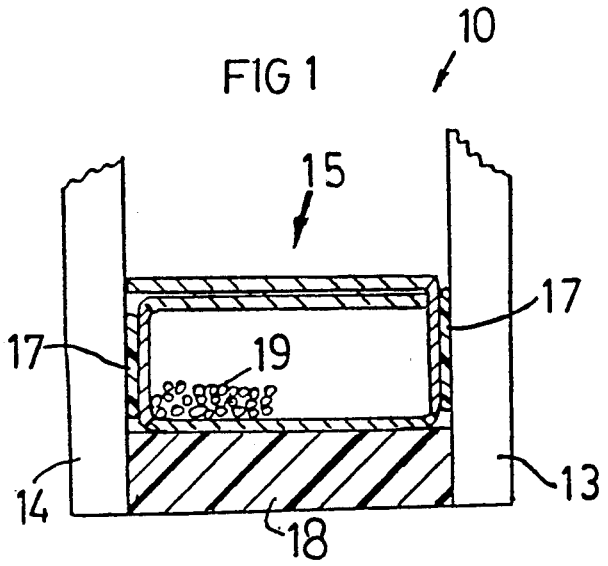
FIG. 1 is an end view, in section, of a portion of a glazing unit incorporating an insulation spacer embodiment in accordance with the present invention.
Figure 2:
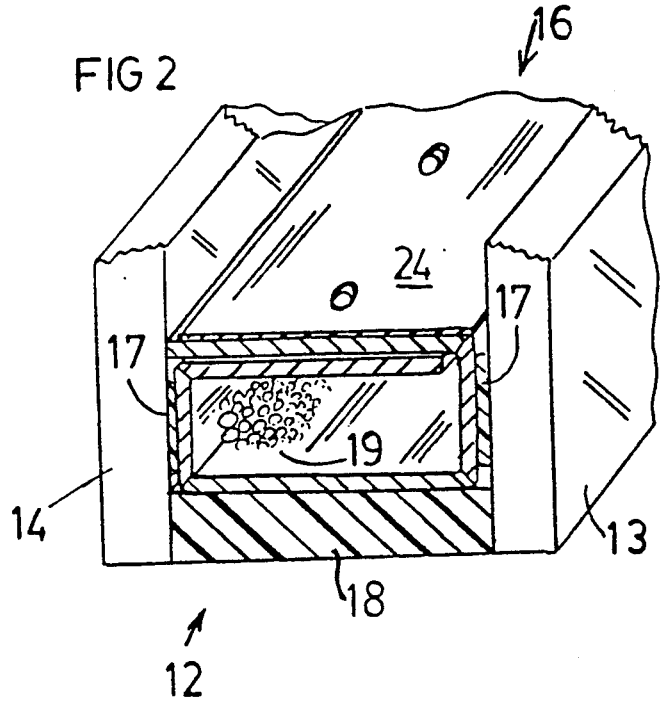
FIG. 2 is a like view, in perspective of a further embodiment incorporating a UV protective film or coating.

Referring to FIGS. 1 and 2, glazing units 10, 12, respectively, have inner and outer glass faces 13, 14, with spacers 15, 16 secured in spacing relation therebetween. Primary seals 17 adhere the spacers 15, 16 in sealing relation with the glasses 13, 14. A secondary seal 18, generally of polysulphide lends mechanical and sealing back-up to the spacers 15, 16. Dessicant 19 is located within the spacers 15, 16. A metallic foil or UV resistant coating, layer 24 generally does not touch the glass faces 13, 14.

Figure 3:
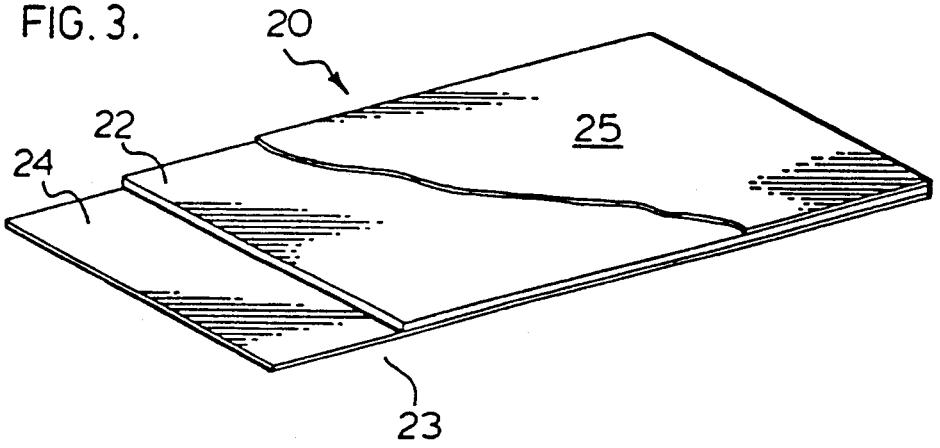
FIG. 3 is an isometric view of a portion of a ribbon embodiment incorporating a series of layered laminations.

Referring to FIG. 3, a continuous length of ribbon 20, according to the present invention, comprises a compound structure having a cardboard layer 22, with a film or foil 24 of gas and moisture impermeable material such as polyvinyl alcohol or polyvinylidene chloride (Saran, T.M.) laminated thereto. A protective coating 25 that is resistant to ultraviolet degradation is applied thereover. This coating 25 may be a suitable thermoplastic elastomer, or other reflective film such as aluminum foil of one half mil or one mil thickness. Silicone thermoplastics have a long life span under adverse environmental conditions.

It may be preferred to use the polyvinyl alcohol and Saran in combination so that the Saran protects the polyvinyl alcohol against water vapour.

Figure 4:
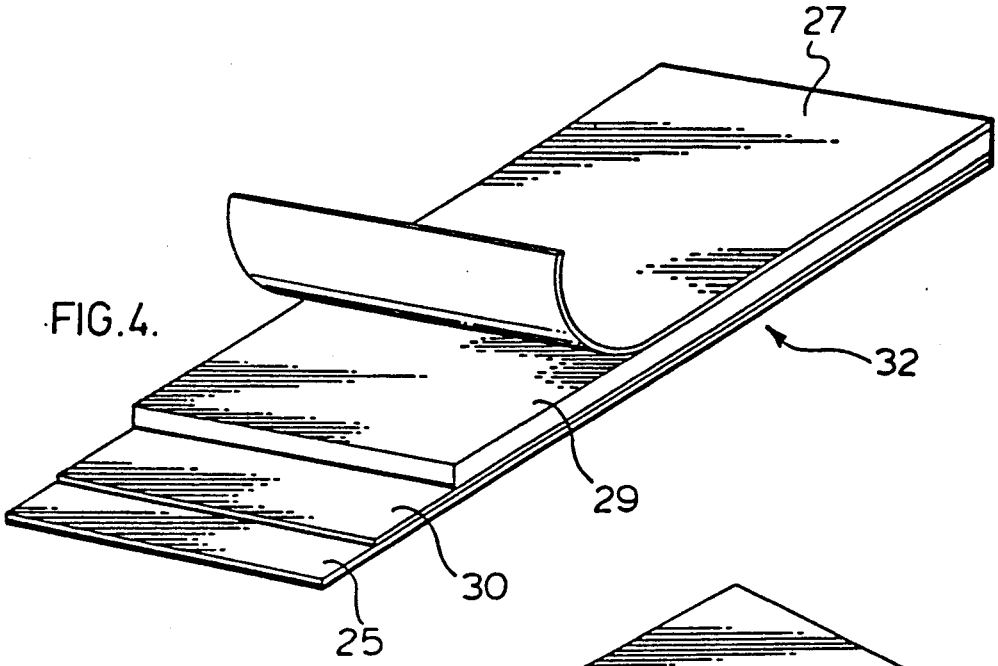
FIG. 4 is a view similar to FIG. 3, of a further ribbon embodiment

The FIG. 4 ribbon embodiment 32 comprises a metallic foil top layer 27 laminated to a substrate 29, of cardboard or plastic, on the underside of which a coating or layer of gas impermeable thermoplastic 30 is adhered. A protective coating 25 that is resistant to ultra-violet degradation may also be included.

Figure 5:
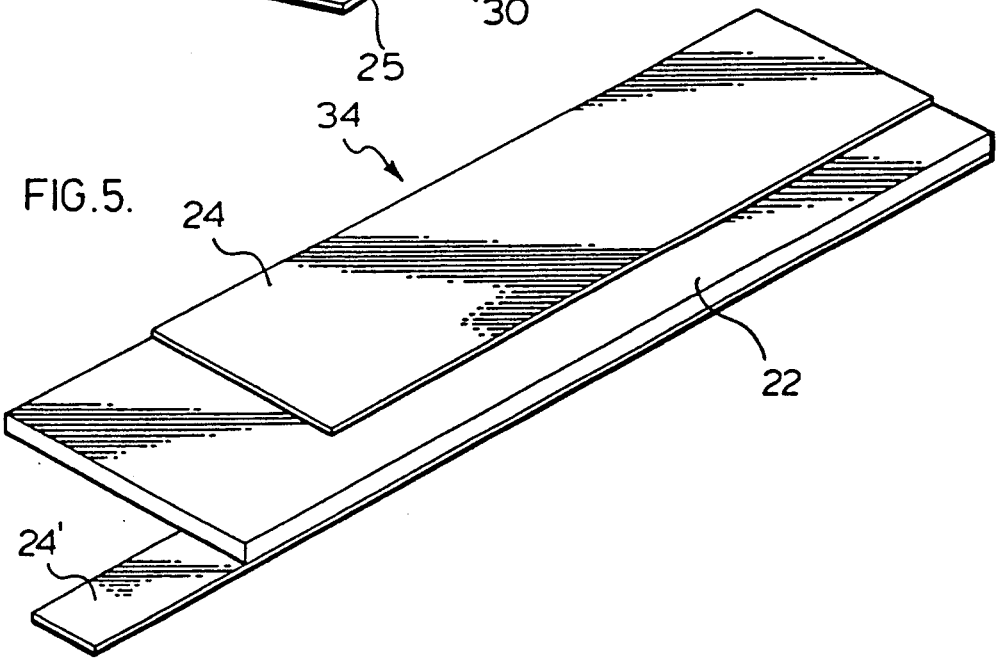
FIG. 5 is a view similar to FIGS. 3 and 4 showing an embodiment incorporating laminations of differing width.

The FIG. 5 embodiment 34 comprises a composite ribbon-like web from which a subject seal/spacer may be fabricated, the ribbon 34 comprising an upper layer of film 24, and a lower foil layer 24' laminated to an intermediate substrate layer 22 of organic material.

It will be noted that in the illustrated embodiment the foil layer 24' is specifically illustrated as covering only a portion of the area of layer 22. As illustrated in FIG. 2 the foil 24' is generally located so as not to "bridge" between the glasses 13, 14.

Figure 6:
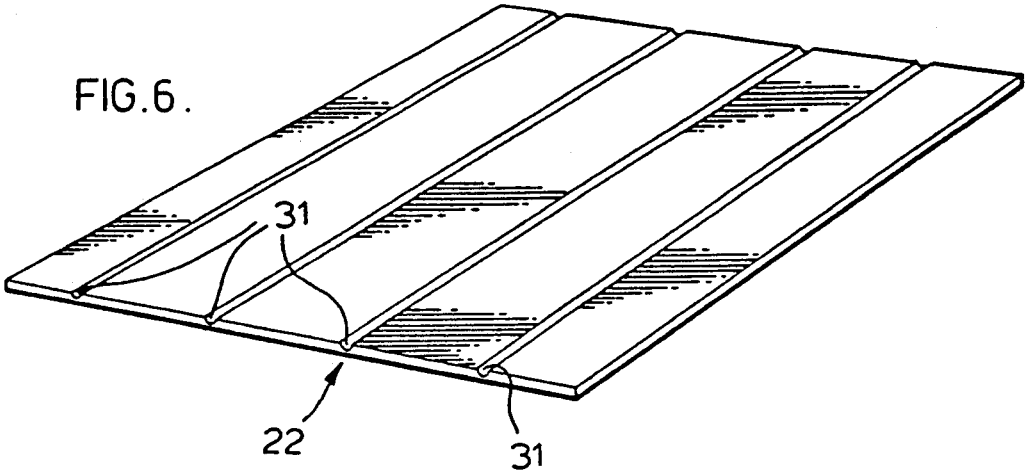
FIG. 6 is a view similar to FIG. 3, of a substrate having panel score lines therealong.

FIG. 6 shows a substrate 22, of plastic or cardboard, having indented fold lines 31 extending in edge parallel relation therealong. In the case of a plastic substrate the substrate 22 may be extruded, incorporating the fold lines 31 integrally therewith. In the case of a sheet of plastic, cardboard, or Keyes fibre board serving as substrate 22, the fold lines 31 may be scored by appropriate means after formation of the substrate 22.

The fold lines 31 may be bevelled at an angle of 45°, to provide fairly precise, stable joints to the corners of the section when folded.

Referring to FIGS. 7A through 7E, FIGS. 7A and 7B show a laminated ribbon 52 having a structure such as one of those previously illustrated, with six longitudinal fold lines defining longitudinal panels 53, 55, 57, 59, 61, 63 and 65.

Figure 7A:
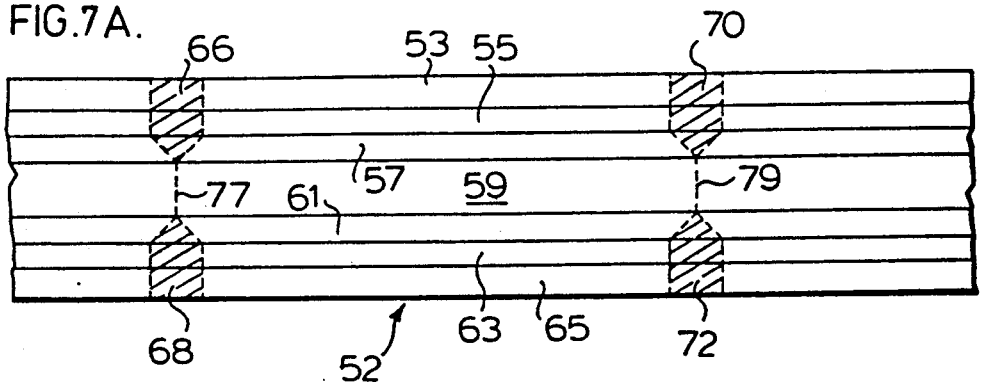
FIG. 7A is a plan view of a multi-panelled ribbon, showing a form of corner joint relief cut-out.
Figure 7B:
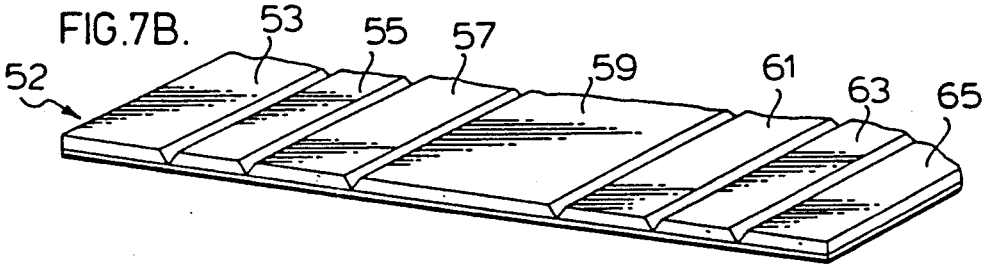
FIG. 7B is an isometric detail of a portion of the FIG. 7A ribbon.
Figure 7C:
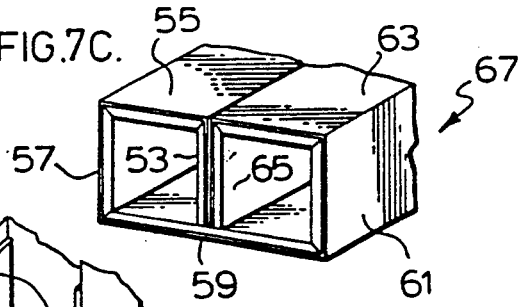
FIG. 7C is an isometric detail of the FIG. 7B ribbon, as a formed section.
Figure 7D:
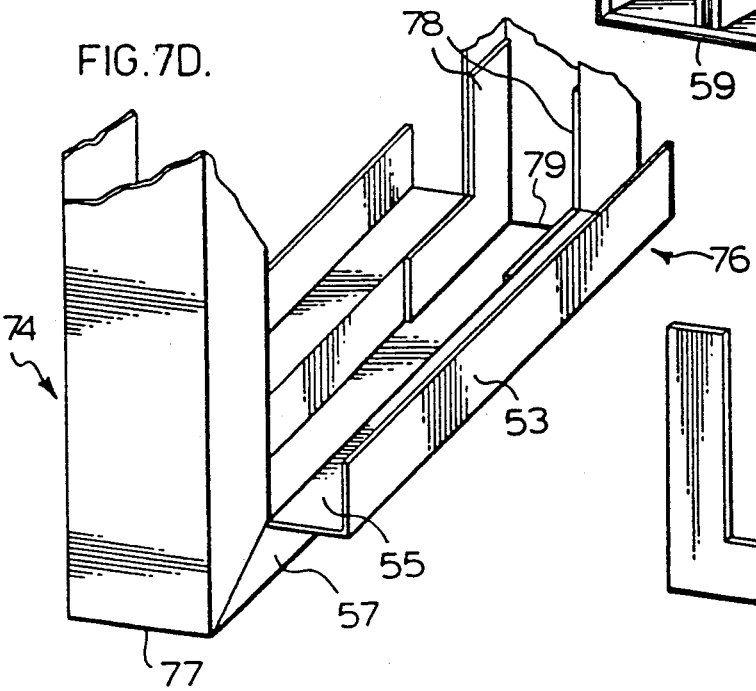
FIG. 7D is an isometric view of the FIG. 7A ribbon in partially erected relation, incorporating separate corner reinforcements.
Figure 7E:
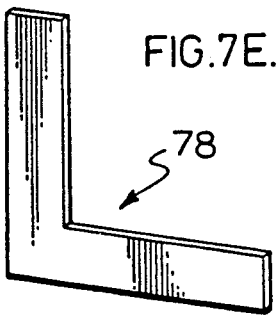
FIG. 7E is an isometric view of a separate corner reinforcement, as incorporated in the FIG. 7D assembly.

The folding over of these panels generates the double section 67 of FIG. 7C, as may be identified by the respective numerals. The cross-hatched areas 66, 68, 70, 72 comprise strike-out areas of the ribbon that are removed, as by cut-out or punching, in order to create corners 74, 76 (FIG. 7D), about fold lines 77, 79. In this embodiment each corner 74, 76 incorporates a pair of L-shaped corner reinforcements 78, FIG. 7E. Generally these corner pieces 78 are glued into position, as indicated in FIG. 7D prior to in-folding of the panels 53, 55; 65, 63, so as to complete the form of section 67. It will be seen in FIGS. 8A, 8B and 8C that a more simple ribbon arrangement 80 incorporating four fold lines and five panels may be severed in the manner indicated in FIG. 7A and the respective three major portions, to form three sides of a frame, constructed into hollow sections 82, 84. A corner joint 86, possibly of cast construction, glued into place, completes each of the four frame corners. It will be evident that corner angles other than 90° may be selected, and the shape of the cut-outs bevel angles varied accordingly.

Figure 9A:
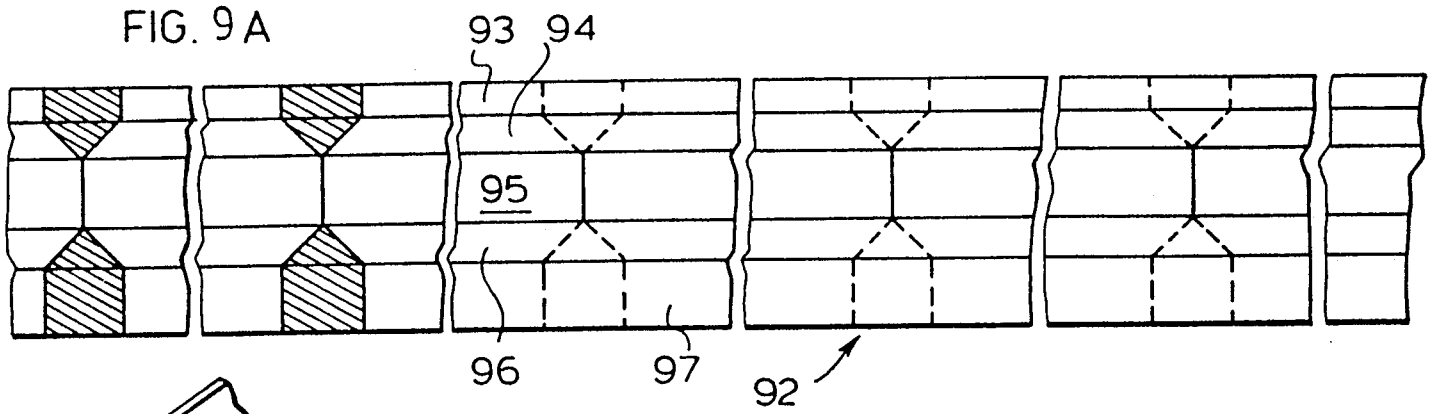
FIG. 9A is a plan view of a further ribbon embodiment showing corner joint relief cut outs.

Referring to the FIGS. 9 embodiment, the ribbon 92, FIG. 9A, comprises five lateral panels, appropriately divided by fold lines. FIGS. 9B and 9C relate the ribbon panels of FIG. 9A to the folding sequence and the final form of the section thus formed.

Figure 9D:
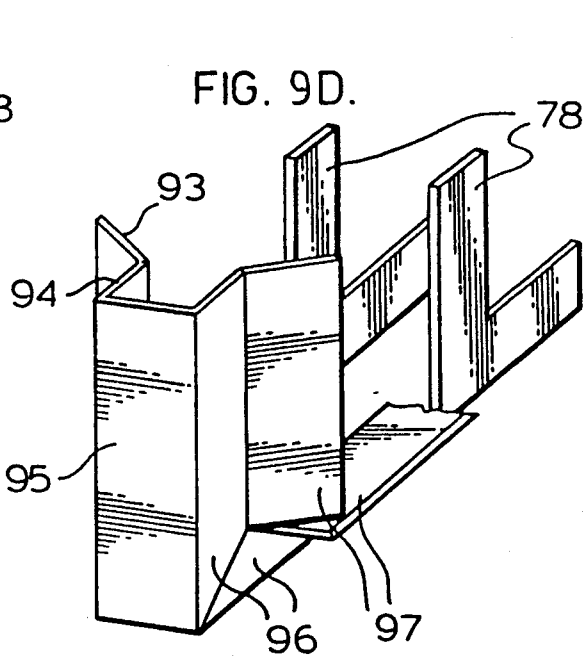
FIG. 9D is an isometric view of a folded corner of the FIG. 9A embodiment, with inserted corner pieces.
Figure 9E:
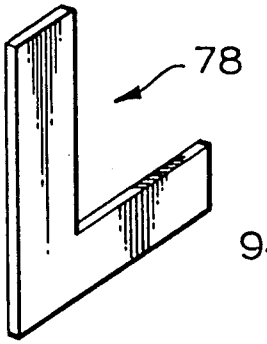
FIG. 9E is an isometric view of an insert corner piece.
Figure 9B:
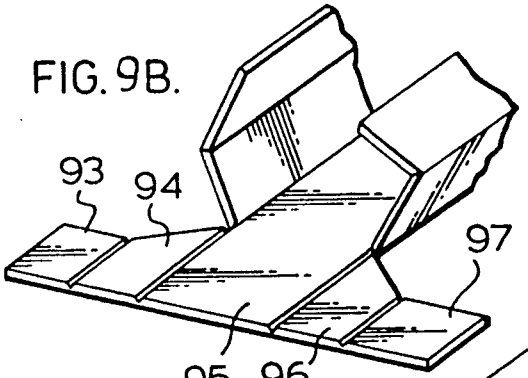
FIG. 9B is an isometric view showing one portion of the FIG. 9A ribbon in partially folded relation, forming a section.
Figure 9C:
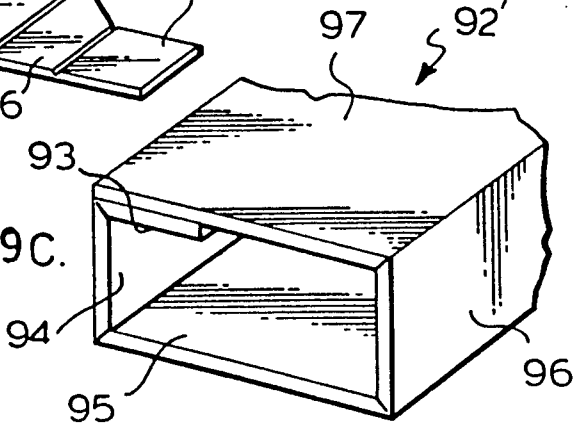
FIG. 9C is an isometric view of the completed section of the FIG. 9A ribbon.

FIG. 9D shows a reinforced corner construction, with reinforcement pieces 78, as for the FIG. 7 arrangement. The respective panels 93, 94, 95, 96 and 97 of the figures are clearly numbered, to show the relationship between ribbon 92, and the section 92' formed therefrom (FIG. 9C). It will be understood that a simple bevelled corner construction, with glued insert corner pieces such as in FIGS. 8B and 8C, may be adopted.

Figure 10:
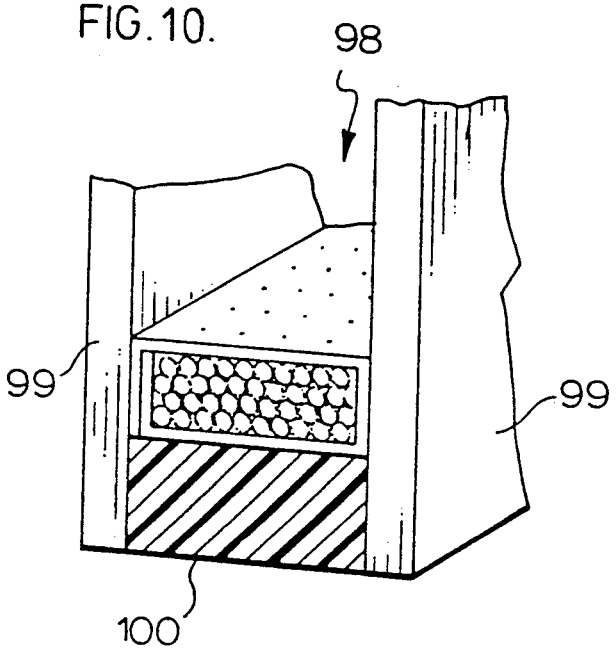
FIG. 10 is an isometric view, in section, of a portion of a window construction incorporating a further spacer seal section embodiment in accordance with the present invention; and, FIGS. 11 and 12 are isometric views, in end view, of two-piece spacer seals, assembled in adhering relation.

FIG. 10 shows another embodiment of the present invention, similar to FIGS. 1 and 2, as a portion of a window installation, taken at a section remote from a corner, wherein a formed section 98 is sealed along the edges thereof to the adjoining panes 99, with a secondary outer peripheral seal 100 of polysulfide or the like applied, as protection and reinforcement therewith.

As previously mentioned, the subject spacer may be made up into a rigid profile, such as is illustrated in FIGS. 1, 2 and 10. Such a length, say a predetermined 7 meters, can then be miter-cut, as indicated at FIG. 7D, using a preformed corner insert 78 or 86, or the like, to make a suitable spacer-frame. In general, such predetermined section lengths would normally have received all requisite surface treatments, and may include the provision of external surfaces bearing contact adhesive, protected by a strippable barrier layer (not illustrated).

Figure 11:
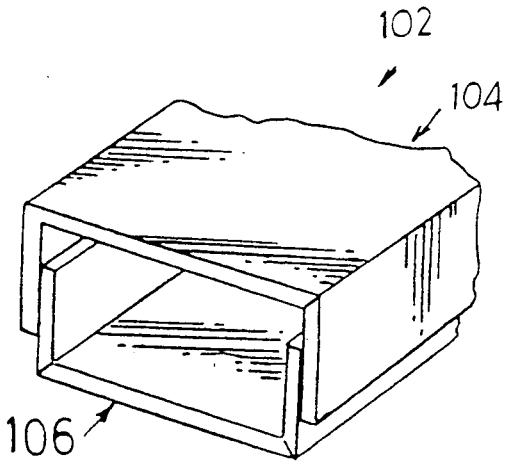
Figure 12:
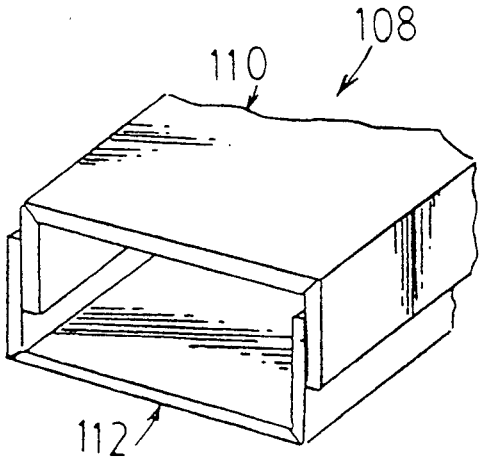

In the FIGS. 11 and 12 embodiments, the seal section comprises a pair of U-sections in mutually adherent relation. The joining of the two section components may be effected using cement or other adhesive, or heat sealing by way of a Saran intermediate coating. The section 102 of FIG. 11 comprises an upper, outer U-section 104, and a lower, inner U-section 106. Section 108 of FIG. 12 comprises U-sections 110, 112. It can be seen in the FIG. 12 embodiment that the same basic section can serve for both halves of the combination. This may also be feasible in the case of the FIG. 11 embodiment.

It will be understood that the reference to windows herein includes constructions such as doors and the like wherein seals of the present invention may be beneficially incorporated. The present described and illustrated embodiments are considered to be but illustrative of the present invention, without intention of limiting the scope of the present invention thereto. The scope of the present invention is defined in the following claims.

INDUSTRIAL APPLICABILITY

Glazing units incorporating the subject seal may be widely used for domestic and commercial windows and doors.

What is claimed:

1. In combination, a multi-pane glazing unit having at least two glazing panes in mutually spaced relation and a composite insulative spacer for the precision separation of said glazing panels in substantially mutually parallel, hermetic sealed relation, comprising a low cost substantially porous, homogeneous resilient web substrate having a coefficient of thermal expansion substantially equal to or less than that of said glazing panels, said web substrate serving, in use, to hold said glazing panels apart, being subject to gas percolation therethrough and being faced with at least one overcladding layer of gas impermeable barrier material selected from the group consisting of polyvinyl alcohol, polyvinylidene chloride, thermoplastic polyesters, ethylene vinyl alcohol copolymers, a thermally isolated thin metallic coating, and combinations thereof, applied in sealing relation to a selected surface of the substrate, said spacer being edge sealed to said panels to enclose and hermetically seal a gas retaining space between said glazing panels.

2. The combination as set forth in claim 1, said barrier material being selected from the group consisting of polyvinyl alcohol, polyvinylidene chloride and combinations thereof.

3. The combination as set forth in claim 1, said overcladding layer extending over both faces of said substrate.

4. The combination as set forth in claim 3, said overcladding layer extending over at least one exposed edge of said substrate.

5. The combination as set forth in claim 1, including a metallic layer secured to one face of said substrate and extending substantially the full length of said spacer.

6. The combination as set forth in claim 5, said metallic layer extending laterally for a portion of the width of said spacer substantially equal to the distance between said glazing panels.

7. The combination as set forth in claim 6, said metallic layer extending in use in closely adjacent, non-contacting relation with said glazing panels.

8. The combination as set forth in claim 1, said spacer being in ribbon form and having a series of longitudinally extending fold lines to facilitate formation of the spacer into channel form.

9. The combination as set forth in claim 8, said fold lines comprising longitudinal creases wherein said substrate is of locally diminished thickness.

10. The combination as set forth in claim 8, said fold lines defining adjoining spacer faces, when folded into tube form, at least one said face having perforations extending therethrough to give access to the interior of said tube.

11. The combination as set forth in claim 10, wherein the edge to edge K value for at least one said spacer face is in the range 0.080 to 0.98.

12. The combination as set forth in claim 1, said spacer being cut to a predetermined length to form a plurality of sequentially adjoining sides, the two ends thereof being joined to form a planar frame-like seal enclosure.

13. The combination as set forth in claim 8, said spacer having four said fold lines to provide five said panels.

14. The combination as set forth in claim 8, said spacer having at least two said fold lines.

15. The combination as set forth in claim 8, said spacer having two outer said panels of said ribbon joined in overlapping, adhering relation to form a reinforced, closed section.

16. The combination as set forth in claim 1, said spacer comprising two tubular sections in mutually spaced relation.

17. The combination as set forth in claim 16, said spacer having one said section inserted partially within the other said section.

18. The combination as set forth in claim 16, said spacer having said sections arranged in mutually overlapping, secured relation.

19. The combination as set forth in claim 1, said insulative spacer being combined with a pair of said panes, the spacer being fabricated into a structural section having a length slightly less than the perimeter dimension of a said pane, with angles therein to conform adjoining lengths of said structural section to the lengths of sides of said pane, the thus formed peripheral seal being secured in sealing, adhering relation with adjoining inner surface portions of said panes, having said insulative spacer secured in continuous sealing relation with said panes to form a hermetically sealed enclosure between the panes.

20. The combination as set forth in claim 15, said peripheral seal including ultra-violet degradation-resistant material, forming a part of said spacer, positioned on the side of the seal adjoining said hermetically sealed enclosure.

* * * * *